US005554053A

United States Patent [19]

Matthews

[11] Patent Number: 5,554,053

[45] Date of Patent: Sep. 10, 1996

[54] MODULAR CONNECTOR WITH SEPARABLE WIRE RETENTION

[75] Inventor: Gary B. Matthews, Austin, Tex.

[73] Assignee: Minnesota Mining and Manufacturing Company, St. Paul, Minn.

[21] Appl. No.: 294,959

[22] Filed: Aug. 24, 1994

[51] Int. Cl.[6] ..... H01R 13/58

[52] U.S. Cl. ..... 439/719; 439/942

[58] Field of Search ..... 439/402–405, 439/719, 942

[56] References Cited

U.S. PATENT DOCUMENTS

| | | | |
|---|---|---|---|
| 3,611,264 | 10/1968 | Killis, Jr. | 339/99 R |
| 3,708,779 | 1/1973 | Enright et al. | 339/99 R |
| 3,713,214 | 1/1973 | Enright et al. | 29/628 |
| 3,772,635 | 11/1973 | Frey et al. | 339/99 R |
| 3,858,158 | 12/1974 | Henn et al. | 339/99 R |
| 3,945,705 | 3/1976 | Selm et al. | 339/98 |
| 4,090,764 | 5/1978 | Malsby et al. | 339/103 M |
| 4,093,334 | 6/1978 | Wickenberg et al. | 339/107 |
| 4,097,106 | 6/1978 | Over et al. | 339/99 R |
| 4,099,822 | 7/1978 | Carlisle et al. | 339/98 |
| 4,127,312 | 11/1978 | Fleischhacker et al. | 339/99 R |
| 4,178,055 | 12/1979 | Fleischhacker et al. | 339/98 |
| 4,236,778 | 12/1980 | Hughes et al. | 339/97 P |
| 4,262,985 | 4/1981 | Muehlhausen, II | 339/99 R |
| 4,272,147 | 6/1981 | Berglund et al. | 339/99 R |
| 4,343,529 | 8/1982 | Reavis, Jr. et al. | 339/198 R |
| 4,423,916 | 1/1984 | Muehlhausen, II | 339/59 M |
| 4,444,449 | 4/1984 | Aysta et al. | 339/99 R |
| 4,446,617 | 5/1984 | Lydell et al. | 29/861 |
| 4,488,769 | 12/1984 | Feigl | 339/103 M |
| 4,538,873 | 9/1985 | Worth | 339/99 R |
| 4,538,874 | 9/1985 | Dambach et al. | 339/99 R |
| 4,552,429 | 11/1985 | van Alst | 439/403 |
| 4,772,231 | 9/1988 | Hayes | 439/752 |
| 4,804,342 | 2/1989 | Rudy, Jr. et al. | 439/467 |
| 4,822,286 | 4/1989 | Blanca | 439/610 |
| 4,836,803 | 6/1989 | Seidel | 439/447 |
| 4,840,581 | 6/1989 | Leufert et al. | 439/472 |
| 4,875,875 | 10/1989 | Archer et al. | 439/401 |
| 5,030,111 | 7/1991 | Eastman | 439/452 |
| 5,030,136 | 7/1991 | Reinhardt et al. | 439/460 |
| 5,125,850 | 6/1992 | Locati | 439/404 |
| 5,125,854 | 6/1992 | Bassler et al. | 439/607 |
| 5,147,218 | 9/1992 | Matthews et al. | 439/404 |
| 5,158,476 | 10/1992 | Kirby | 439/471 |
| 5,307,243 | 4/1994 | Sharp et al. | 439/457 |
| 5,370,558 | 12/1994 | Scherer | 439/719 |

FOREIGN PATENT DOCUMENTS

| | | | |
|---|---|---|---|
| 8405217 | 10/1984 | Brazil . | |
| 203365 | 12/1986 | European Pat. Off. . | |
| 2331169 | 6/1977 | France . | |
| 2515688 | 4/1976 | Germany | 439/942 |
| 2103432 | 2/1983 | United Kingdom . | |
| 2256542 | 6/1991 | United Kingdom . | |

*Primary Examiner*—Neil Abrams

*Attorney, Agent, or Firm*—Gary L. Griswold; Walter N. Kirn; Jack V. Musgrove

[57] ABSTRACT

A modular, multiple-wire connector has a connector body (10) with insulation displacement contacts (18) or twisted plug contacts to allow the modular interconnection of a plurality of wires, particularly pairs of telecommunications wires, and further includes a cover which is releasable from the connector body to expose the terminal portions of a first set of the wires at their connection points, and a wire retention strip (40) which is separably attached to the connector body along an edge thereof. Variations of the connector body (10) and wire retention strip (40) are disclosed, and several similar or different strips may be used on a single connector body. The wire retention strip (40) may have two rows of wire retention posts (44) along both edges thereof, and the connector body (10) may be designed to receive two such strips (40), one on either side thereof.

7 Claims, 6 Drawing Sheets

MODULAR CONNECTOR WITH SEPARABLE WIRE RETENTION

BACKGROUND OF THE INVENTION

1. Field of the Invention

The present invention generally relates to the interconnection of electrical wires, and more particularly to improved wire retention in a modular connector for splicing systems, particularly those used in the interconnection of a plurality of pairs of communications wires. The device includes a main connector body and a wire retention structure which is separably attached to the connector.

2. Description of the Prior Art

There are many prior art systems relating to the interconnection of electrical (copper) wires. One commercially successful modular splicing system used for the interconnection of telephone wire pairs is that described in U.S. Pat. Nos. 3,708,779, 3,713,214, 3,945,705 and 5,030,136, and which is sold by Minnesota Mining and Manufacturing Co. (3M—assignee of the present invention) under the brand name $MS^2$. The design of one the $MS^2$ connectors, shown in FIG. 1, is generally rectangular in shape and includes a body bottom portion 1, a body top portion 2, a base or bottom protector 3, and a cover or top protector 4, with a plurality of insulation-displacement, or self-stripping, contact members 5 each having a pair of U-shaped ends for receiving a terminal portion of the wires, and cut-off blades 6 for clipping off the excess portion of the wire ends. Base 3 has a plurality of latches 7 for attachment to body cover 4 has a plurality of similar latches 8. One embodiment is provided with 50 such contacts to allow the simultaneous interconnection of up to 25 pairs of wires. Variations of the $MS^2$ connector are available for permanent connections as well as bridging or pluggable modules for use in transfers, cutting load coils, and adding relief stubs without interrupting service. Half-tap modules are also available. The cover and base may be clear to allow for visual inspection of the conductors. In addition, the base may be provided with test ports (not shown) to allow for the insertion of probe tips during the splicing operation. The connector may be encapsulated, or formed into preterminated jumper assemblies. See also U.S. Pat. No. 4,093,334 regarding a special base retainer for factory pretermination and testing. The size of the connector and internal elements may vary depending upon the gauge range of the wires to be interconnected. The $MS^2$ connector is provided in many different variations for different wire size ranges and types of cable construction, i.e., 10 pair and 25 pair binder groups.

The design of the $MS^2$ connector allows the cover to be removed from the terminated connector body, which enables access to the wires for correction of splicing errors and for maintenance of individual wires within these multiple-pair connectors. Covers must also be removed when plugging additional connector bodies together, in those embodiments which allow vertically plugging of connector bodies, each of which contains one or more sets of terminated wires. While these assembled splice connector designs meet all of the mechanical test standards for the telephone industry, the wires can still become dislodged from their connection points during handling, i.e., when the cover is removed. This is especially true for the largest size wires used in the miniature versions of these connectors. A sorting and splicing station, such as that shown in the '214 patent, may include means for managing the wires during splicing. That splice head provides a spring coil to hold the wires, and individual wire guides aligned with the connector body. This splice head is, however, very bulky and difficult to use during maintenance operations in high-density environments, although stripped-down versions are available to provide minimal support and anchoring. See also U.S. Pat. No. 4,446,617.

Improved strain relief in modular connectors was addressed in U.S. Pat. No. 5,030,136 by the addition of a strain relief feature which is integrally formed with the connector body along an inner portion thereof. This addition, however, results in a wider connector body and more complicated molding tool design. One major obstacle to providing performance improvements to the primary $MS^2$ design, and to any prior an design, is the requirement of maintaining compatibility to all the previously installed connectors and to the application tooling that comprises the system. A further goal is to be able to utilize existing manufacturing processes for any improved system. Accordingly, the '136 construction does not meet the desiderata relating to compatibility. More specifically, there is not enough space in the existing $MS^2$ connector footprint to make any feature which would be robust enough to accomplish the wire-holding objective. Any such features would also be very fragile and present difficulties in manufacturing or assembly operations.

The challenge in providing suitable strain relief in miniature, multiple-pair connectors is directly related to the range of wire sizes used in the connector. A feature that holds the smallest wire size will likely experience excessive interference with the largest wire size, making the connector more difficult to splice in those cases. This effect is present in the wire-holding and strain relief geometry of two other prior art designs, those disclosed in U.S. Pat. Nos. 3,611,264, 3,772,635, 3,858,158, 4,262,985 and 4,423,916. Different sizes of certain components, such as the index strip, are necessary with those designs, to accommodate the entire wire size range. An imitation of the $MS^2$ design, modified by using a wire-holding geometry similar to the "bat-wing" design of the '985 patent, is shown in Brazilian Patent Application No. 8405217, but is generally deemed inferior due to manufacturing and performance disadvantages. The barbed structures discussed in U.S. Pat. Nos. 4,178,055 and 4,836,803 present similar difficulties. Common strain relief designs are likewise not satisfactorily compatible, including those using wire gripping flanges (see U.S. Pat. Nos. 4,127,312, 4,444,449,), those using crimped or deformable sidewalls (see U.S. Pat. Nos. 4,097,106), and those having insulation gripping surfaces (see U.S. Pat. Nos. 4,099,822, 4,236,778, 4,343,529). In all of these designs, the wire retention is integrally formed as part of the connector assembly. There are descriptions of multiple-pair connectors with attachable or separable members providing strain relief, but these generally bundle all the wires together. Thus, these separable members must be removed to gain access to a single wire, exposing all the wires to movement near the contact points; see U.S. Pat. Nos. 4,090,764, 4,488,769, 4,804,342, 4,822,286, 4,840,581, 5,030,111 and 5,158,476. Hinged strain relief members that are held in place over the wires by latches at the ends of the wire array suffer a similar limitation (see U.S. Pat. Nos. 4,538,873 and 4,875,875). Some modular multiple-pair connectors for flat cable have separably attached strain relief members that must be removed to gain access to the wire connections; see U.S. Pat. Nos. 4,538,873 and 5,125,850.

In summary, all of the prior art wire retention and strain relief techniques, when considered in combination with the $MS^2$ construction, suffer from a wide range of design compromises, performance limitations and manufacturing difficulties. Moreover, none of these designs allow the placement of the wire retention device as an option such that the device is easily added to or separated from the connector body, nor do they provide flexibility in application. It would, therefore, be desirable to devise an improved wire retention and strain relief geometry for securing the wires during cover removal, which overcomes size and compatibility constraints to allow simple hand-held splicing and a mix of wire retention features on a single connector module. It would be further advantageous if the connector design accommodates separably attached wire holding and alignment features on both sides of the connector body without interfering with existing functionality.

SUMMARY OF THE INVENTION

The present invention provides a modular connector for interconnecting a first plurality of wires to a second plurality of wires, respectively, and generally comprising an elongate connector body having a plurality of insulation displacement contacts (IDC's) disposed therein for establishing electrical connection between respective wire pairs, a cover member removably attached to the connector body such that the cover member urges the first plurality of wires toward one U-shaped end of the IDC's when said cover member is attached to said connector body, bringing the copper core of the wires into electrical contact with respective IDC's, and an elongate wire retention strip, not longer than the connector body, which has means for holding the first plurality of wires proximate their connection points with the IDC's, thereby minimizing disruption of the electrical connection during handling of the connector. The wire retention strip is separably attached, or releasably secured, to the connector body with the strip oriented generally parallel with the connector body.

In a more specific embodiment, the present invention relates to a modification to the $MS^2$ connector body design that provides mechanical locking of a wire retention strip along the edge of the connector. The latch rail along the edge of the prior art connector body is modified by providing a plurality of dovetail cavities at the edge of the connector, and the wire retention strip is provided with integrally formed mating dovetail structures. This design concept allows the wire retention strip to be produced as a separate piece and then attached to the connector, either during the connector body assembly process or after the completion of the connector assembly operation. The shape of the dovetail feature on the wire retention strip is modified to allow the strip to be pressed or "zippered" onto the assembled connector module in a final manufacturing step, or in the field. Since the strips may be attached to the connector body in a separable manner, a wide variety of strips may be designed, including synergistic geometries, to expand the utility of the basic connector assembly. The strips are readily added or removed from the connector as required for their specific functionality. The material of the strips, as well as the connector body, is preferably a resilient, injection-moldable polymer which is sufficiently flexible to offer ease in use but still strong enough to remain attached to the connector body and perform the basic requirements of wire holding and aligning.

BRIEF DESCRIPTION OF THE DRAWINGS

The invention will best be understood by reference to the accompanying drawings, wherein.

DESCRIPTION OF THE PREFERRED EMBODIMENT

Figure 2A:
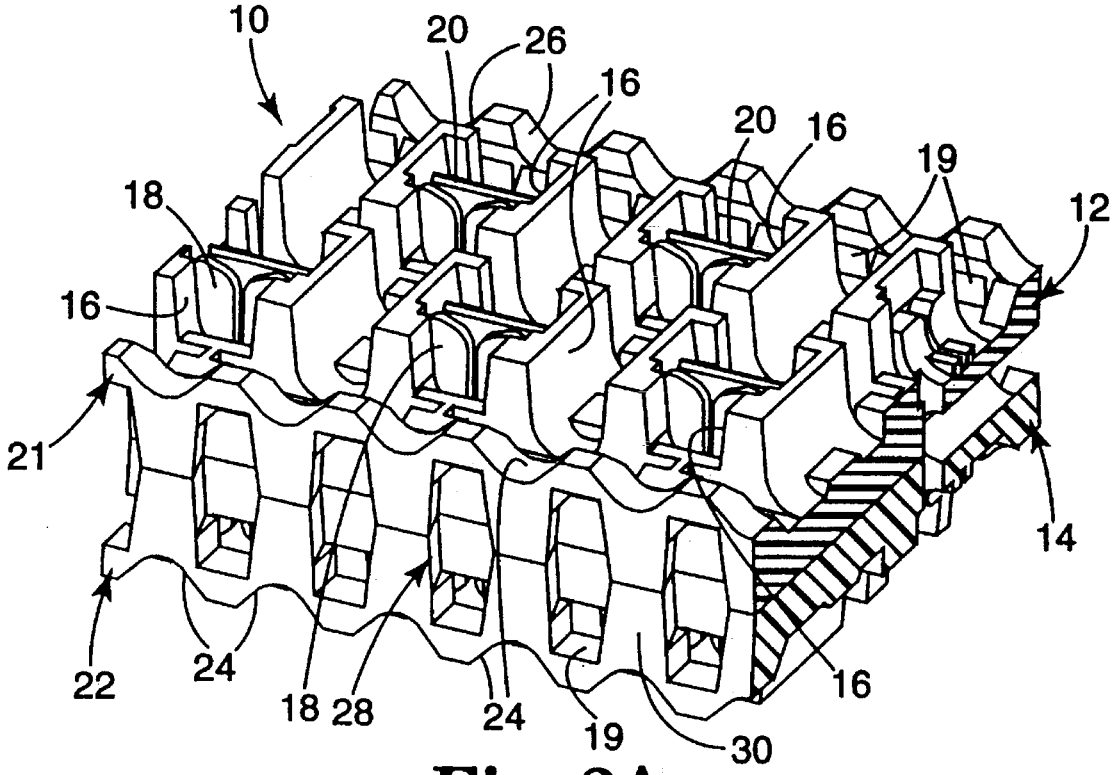
FIG. 2A is a partial perspective view and section of one embodiment of the connector body constructed according to the present invention, showing the modified dovetail cavities.

With reference now to the figures, and in particular with reference to FIG. 2, there is depicted one embodiment 10 of the connector body used in the modular, multiple-pair wire connector of the present invention. Connector body 10 is generally comprised of a top body portion 12 and a bottom body portion 14 which are similar to the top and bottom body portions of the 4000D $MS^2$ connector body design ("4000D" is a trademark of 3M). Each of the top and bottom body portions 12 and 14 include a plurality of cutouts or channels 16 for receiving individual wires and for aligning them with a respective one of a plurality of insulation displacement contacts (IDC's) 18. In the illustrated embodiment, each IDC 18 has two U-shaped ends, as are known in the art, which remove a portion of the insulation around the copper wire core and deform the wire, making a reliable gas-tight connection in a simple crimping operation. A plurality of cut-off blades 20 are also provided to remove the excess length from the terminal portion of the wires. The IDC elements and cut-off blades are metallic, preferably phosphor bronze and stainless steel, respectively, and are held in the connector body by means of various flanges, walls and cutouts formed in the top and bottom portions 12 and 14. The cutouts extend completely through the outer surfaces of top and bottom body portions 12 and 14 to allow attachment of the wires on the opposite surfaces of the connector.

Figure 1:
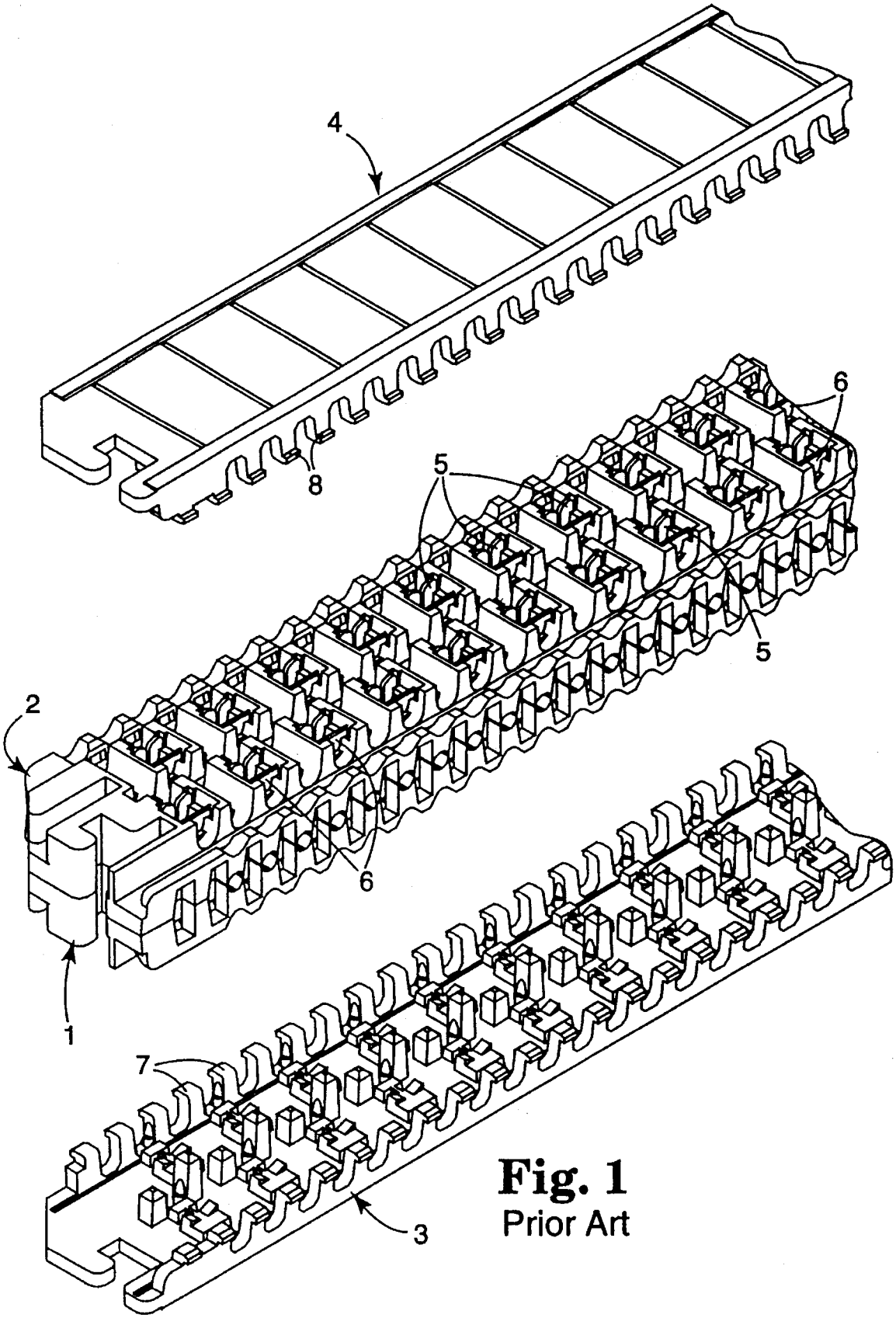
Fig. 1 Prior Art
FIG. 1 is an exploded perspective view of a prior an modular, multiple-pair connector for telecommunications wires.

A cover and base are also provided (not shown in FIGS. 2A–2B) which, in the preferred embodiment, are identical to cover 4 and base 3 of the prior art connector, thereby maximizing compatibility with the prior art design. Indeed, except for the dovetail cavities discussed in the following paragraph, the construction of the preferred embodiment of top and bottom body portions 12 and 14 is identical to the prior art construction to minimize changes to tooling and molds. The cover and base include the same surface structures as in the prior art design to complement those on the top and bottom connector portions. Specifically, hooks are formed along the edges of the cover and base for removable attachment with latches 19 formed along the edges of top and bottom portions 12 and 14, and ridges or bumps are formed along the inside surface of the cover for pushing the wires against the contact elements and cut-off blades when the cover/base is firmly pressed onto connector body 10. The cover and base may also have guides, channels, posts, etc., to keep the wires aligned properly. Top portion 12 and bottom portion 14 have respective edges 21 and 22 with a serpentine pattern or series of arcuate cutouts 24 to provide nominal alignment of the wires with wire channels 16 and IDC's 18. Another set of cutouts 26 may be formed on opposing edges of connector body 10, i.e., on the wire cut-off side. Cutouts 26 are useful in the initial splicing operation and thereafter, when no wires extend therethrough as the excess wire has been trimmed and removed, the resulting openings may be used to receive the tips of a separation tool. The ends of top and bottom portions 12 and 14, as well as the ends of the cover and base, preferably have a construction as shown in FIG. 1 which allows alignment with system components such as the splice head, or attachment to a frame or bracket. As with the prior art top and bottom portions 1 and 2, top and bottom portions 12 and 14 of connector body 10 are nearly mirror images.

Figure 4A:
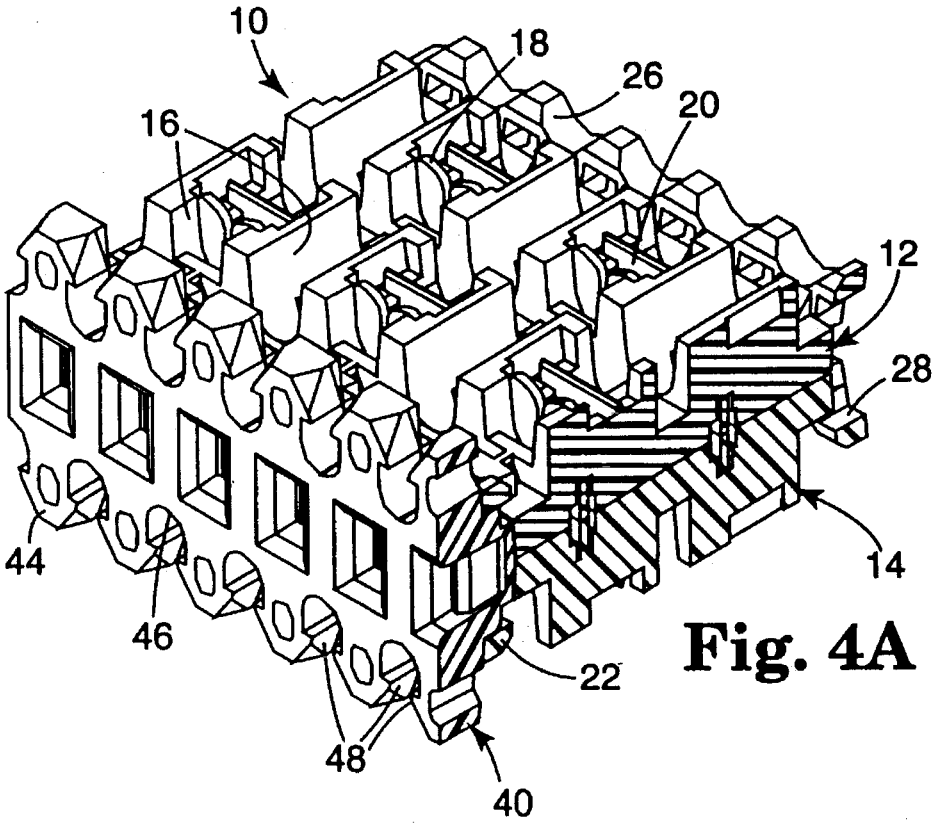
FIG. 4A is a partial perspective view and section illustrating the attachment of the wire retention strip to the connector body.
Figure 4B:
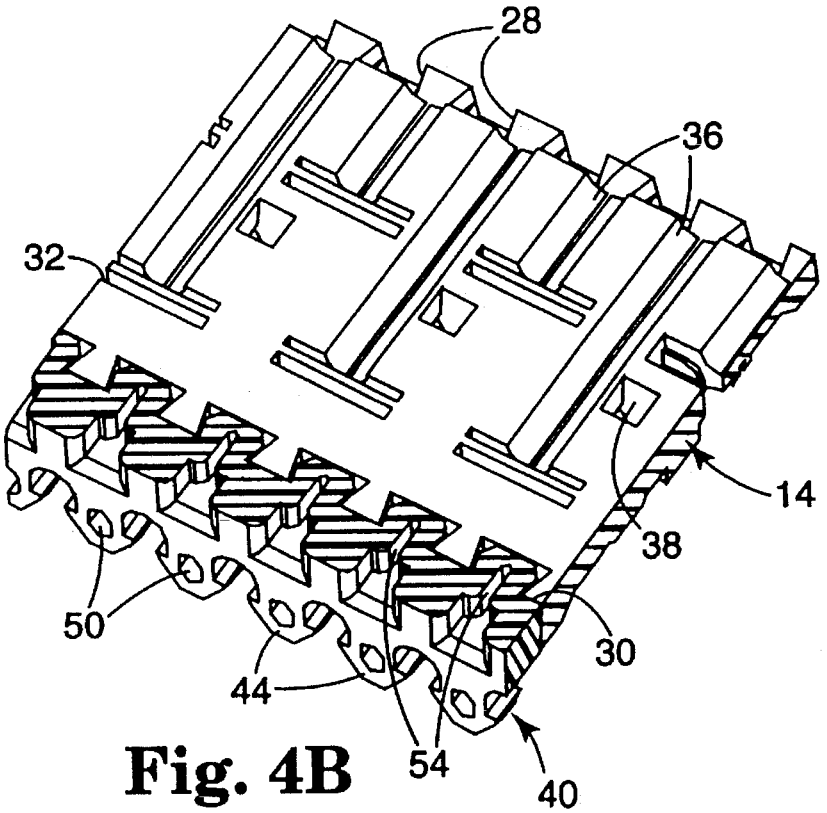
FIG. 4B is a partial perspective view and section similar to FIG. 4A but removing the top portion of, the connector and also showing the strip in section.

The primary change to connector body 10 from the prior art construction is the provision of a plurality of dovetail-shaped cavities 28 formed in the sidewall 30 of connector body 10. The term dovetail is not to be construed to mean only a notch having a regular trapezoidal cross-section, but more broadly refers to any cavity having an opening which is smaller than a rear area of the cavity. The cavity is accordingly designed to receive an interlocking protrusion having a base area and a distal portion, the distal portion having a width or area which is larger than the width or area of the base; the maximum (distal) width of the dovetail protrusion should be greater than the minimum (entrance) width of the cavity. In the preferred embodiment, cavities 28 are defined by complementary notches formed in each of the top and bottom portions 12 and 14, with dovetail angles of 15°–25°. Those skilled in the art will appreciate the manner in which location of cavities 28 in the illustrated embodiment complements the prior art 4000D geometry, with respect to both use of the connector during splicing and maintenance, and during the molding process which creates top and bottom portions 12 and 14. As previously intimated, dovetail cavities 28 are aligned with latches 19, meaning that cavities 28 are generally interposed between adjacent wire channels 16 since latches 19 must similarly lie between the wire channels, due further to the placement of the hooks on the cover and base of the connector. The provision of cavities 28 on each side of a wire channel 16, arranged in series parallel with connector body 10, further enhances the use of attachable strips as explained below. As seen in FIGS. 4A and 4B, dovetail cavities 28 may also be formed in the cut-off side of connector body 10.

Figure 2B:
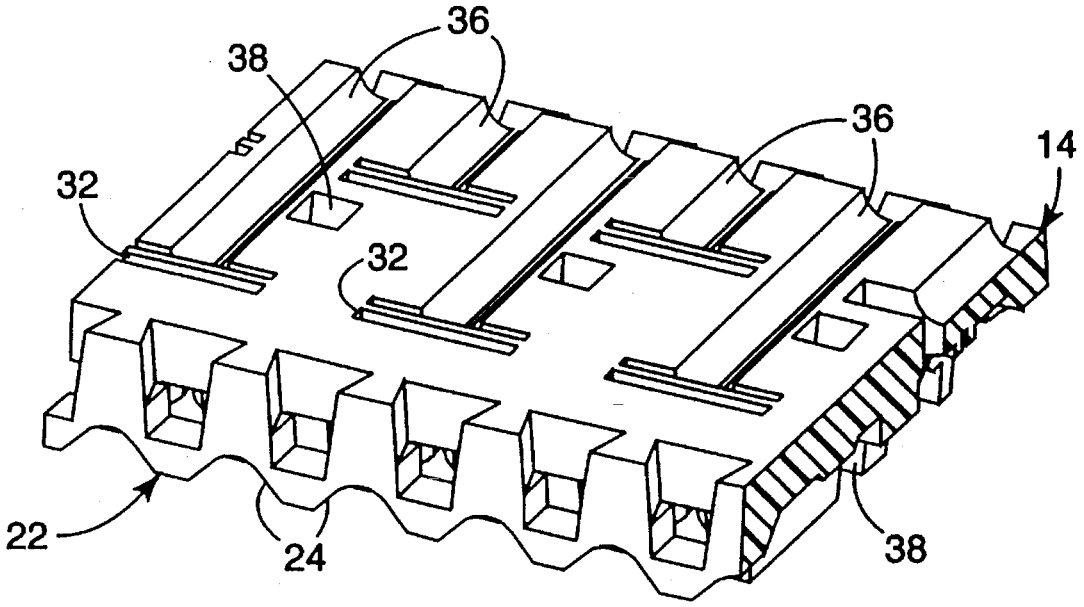
FIG. 2B is a partial perspective view and section of the bottom portion of the connector body of FIG. 2A, showing more clearly the dovetail shape of the cavities.

The dovetail shape of cavities 28 is visible in FIG. 2B as highlighted at detail A. While this detail more clearly depicts the dovetail in section along the interface between top and bottom portions 12 and 14, the preferred embodiment further contemplates an additional dovetail contour of the cavities in the Z-axis, that is, the cavity is wider at its center portion than at the ends adjacent latches 19. FIG. 2B also shows the cutouts 32 formed through bottom portion 14 to receive the IDC's 18. FIG. 2B further depicts more clearly interior channels 36 which may optionally be formed in bottom portion 14 which form test ports when channels 36 are located opposite corresponding channels in top portion 12. Holes 38 are designed to receive locating posts on the connector base.

Figure 3:
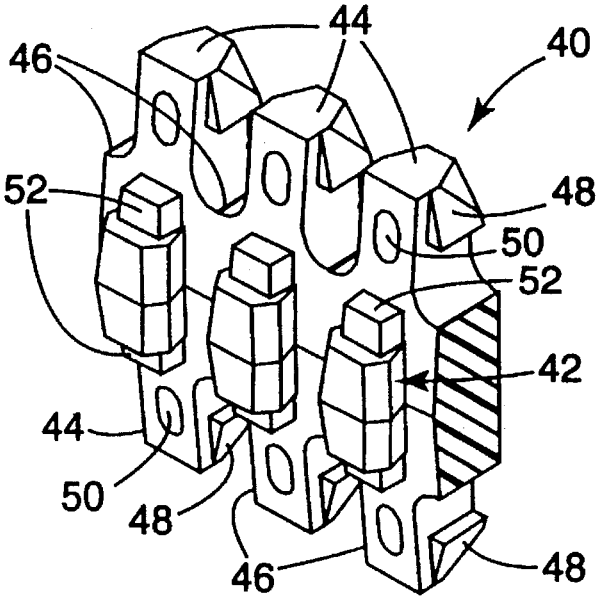
FIG. 3 is a perspective view showing a portion of one embodiment of a wire retention strip having dovetail protrusions for mating with the cavities in the connector body.

Referring now to FIG. 3, a wire retention strip 40 is shown, hereinafter referred to as a pair-splitter strip, which is designed for releasable attachment to connector body 10. Pair-splitter strip 40 has a plurality of dovetail protrusions 42 sized and arranged to mate with dovetail cavities 28 in connector body 10. The forwardmost edges of dovetail protrusions 42 may be beveled or truncated to ease insertion of the lead-in into the cavities. Strip 40 includes means for retaining wires when strip 40 is attached to connector body 10, such means in the preferred embodiment comprising a plurality of posts 44 defining adjacent wire-receiving slots 46. Posts 44 and slots 46 provided along both edges of strip 40, to provide wire retention for both the first plurality of wire pairs which are connected to top portion 12, and the second plurality of wire pairs which are connected to bottom portion 14. Posts 44 preferably have angled faces and integrally formed wings or wedges 48 which serve to split a pair of wires and capture them in slots 46, thereby aligning them with their respective channels 16. Holes 50, preferably oblong in shape, are advantageously formed in posts 44 to allow wedges 48 to flex toward the post centerline, easing wire insertion, and to allow the post to skew away from an adjacent wire during insertion. The provision of wedges 48 and holes 50 also allows strip 40 to be used effectively with a larger range of wire sizes. The post construction may be slightly modified for use with particularly small wire gauges by adding wings (not shown) to the sides of the posts, partially obstructing slots 46. These wings are sufficiently thin such that they will break away when a larger gauge wire is used, but still stiff enough to secure the smaller wires in the reduced-sized slots. Due to the previously mentioned placement of cavities 28 between adjacent wire channels 16 in connector body 10, the preferred embodiment of pair-splitter strip 40 consequently locates each dovetail protrusion in alignment with the posts 44. Rectangular projections 52 fit against the bottom portion of the latch openings 19 in top and bottom portions 12 and 14, and resist vertical forces applied by the wires from the opposite side of the connector.

FIGS. 4A and 4B show attachment of pair-splitter strip 40 to connector body 10. As seen in FIG. 4A, wire slots 46 of strip 40 are aligned with respective cutouts 24 and channels 16 of connector body 10. The dovetail fit is designed to allow quick, hand- or hand-tool actuated attachment of strip 40 by simply pressing it into sidewall 30 of connector body 10, and is removed equally simply. Nevertheless, strip 10 offers not only improved retention of the wires during splicing and maintenance, but additionally imparts greater strain relief to the exiting wires, preventing or at least minimizing breakage of the wire or displacement thereof from the IDC element. These functions are provided with only minor modification of the size and shape of the overall connector assembly; moreover, since strip 40 is removable, it can be discarded if space requirements become critical, after splicing or maintenance. The cross-section seen in FIG. 4B of the dovetail protrusions also illustrates the preferred construction of a core 54 within each protrusion which imparts greater flexibility and thus ease of use when both attaching or removing strip 40. Core 54 also allows a larger engageable surface to be designed at the distal end of protrusions 42. The dovetail design further provides self-centering of protrusions 42 in cavities 28. Those skilled in the art will appreciate that the protrusions and cavities may be reversed, i.e., the cavities may be formed in strip 40 and the protrusions on connector body 10, although this may result in diminished compatibility with other system components.

Once strip 40 is attached to connector body 10, the wires may be placed between posts 44, in slots 46, by any convenient means. For the set of wires entering top portion 12, it is easy to insert the wires by hand during the splicing operation. The bottom set of wires may be inserted into wire slots 46 of strip 40 using an adapter plate (not shown) having ramped ribs which push the wires into slots 46.

In the embodiments of connector body 10 wherein dovetail joints are used to secure strip 40 to connector body 10, both of these components are constructed of a resilient material, preferably an injection-moldable polymer such as polycarbonate, PBT polyester, a polycarbonate/polyester blend, or a polycarbonate/polyurethane blends. A modulus of at least 100,000 psi is preferred for retaining the strip to the connector with the 15° dovetail design, and a modulus of 150,000 psi provides wire retention performance that enables the wire to be repeatedly flexed in a bending test under a ½ lb. load, resulting in wire breakage at the outside edge of the wire retention strip, while still retaining the wire in the IDC. Some of the strip designs work well with a material having a modulus of as much as 340,000 psi. The ability to use materials that are "softer" (lower modulus than that of the material used in the connector body, e.g., 340,000 psi) i also advantageous. Use of a softer material results in easier splicing of the largest wires, and minimizes the likelihood that softer wire insulation will accidentally be cut through, as can occur in some prior art connector strain relief designs. This construction thus helps to ensure that proper electrical performance of the connector is maintained for all wire types.

Figure 5:
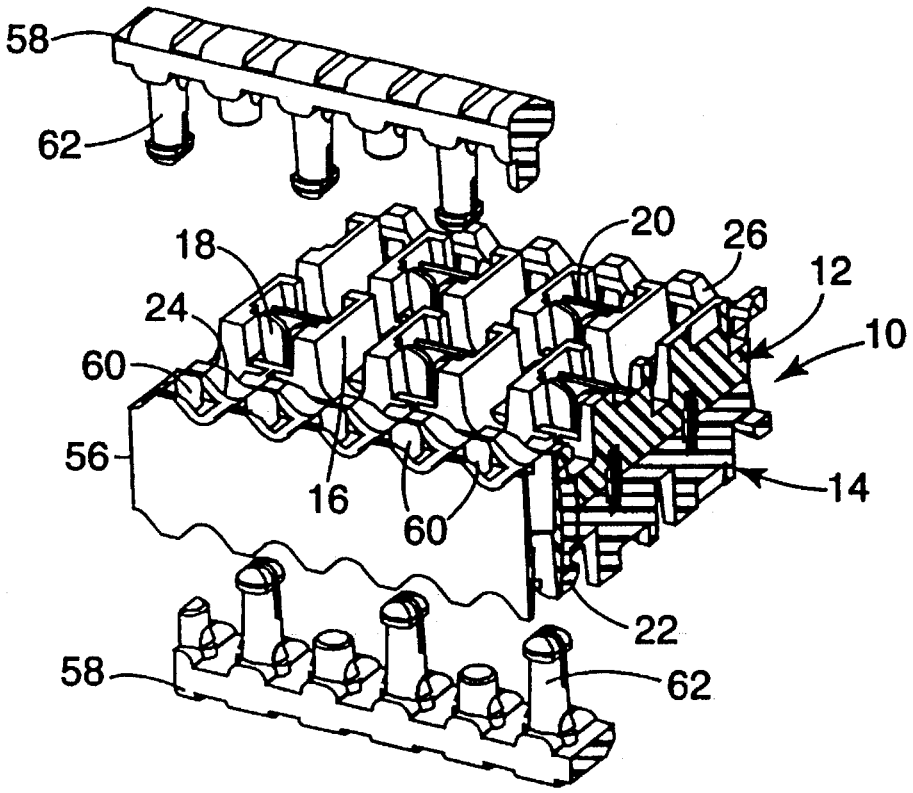
FIG. 5 is a perspective view of another embodiment of a wire retention strip, including a locking strip which attaches to the connector body and one or more locking rails used to secure the wires to the locking strip.

As with all of the following strip variations, pair-splitter strip 40 may be any length, i.e., it may accommodate a variable number of wires, although it should not be significantly longer than connector body 10. In this manner, two or more strips may be used on a single connector body to provide different functionality as necessary, or different wire retention constructions may appear on the same strip, i.e., along the top and bottom edges. One such strip variation is shown in FIG. 5. In that embodiment, the wire retention strip now takes the form of a locking strip 56 and one or more locking rails 58. Locking strip 56 is attached to connector body 10 using the same dovetail design, but there is no wire retention feature integrally formed with strip 56, so there is no change in the feel of the connector assembly during splicing. Locking strip 56 does, however, have several holes 60 therein along the top and, optionally, bottom edges which are designed to accept mounting studs 62 formed on locking rail 58. Studs 62 may be provided with a flange that engages an annular ledge or groove inside holes 60 to provide a positive locking action. Later access to individual wires can be accomplished by cutting a segment out of the rail or by pulling the wire from between rail 58 and locking strip 60 (after the wire has been lifted from the IDC). Locking rails 58 may be added to all connectors in a splice after completion of the initial splicing operation, or may be added later only to those connector bodies 10 that are opened up for maintenance after splicing. When locking rail 58 is attached to locking strip 56, it captures the wires between an edge of locking strip 56 and rail member 58. Locking strip 56 is preferably provided with the similar serpentine pattern of edges 21 and 22, to better align the wires. The material of locking strip 56 and locking rails 58 is preferably stronger than that used with pair-splitter strip 40, since holding strength is improved while splicing performance is unaffected.

Figure 6:
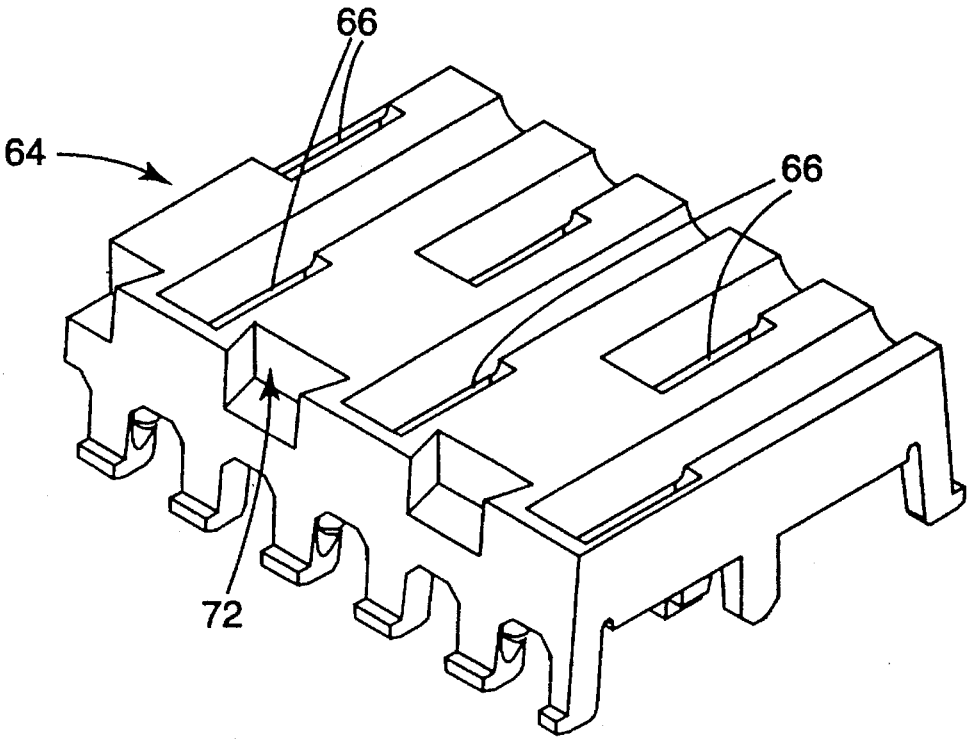
FIG. 6 is a perspective view and section of an alternative connector body bottom portion.
Figure 7:
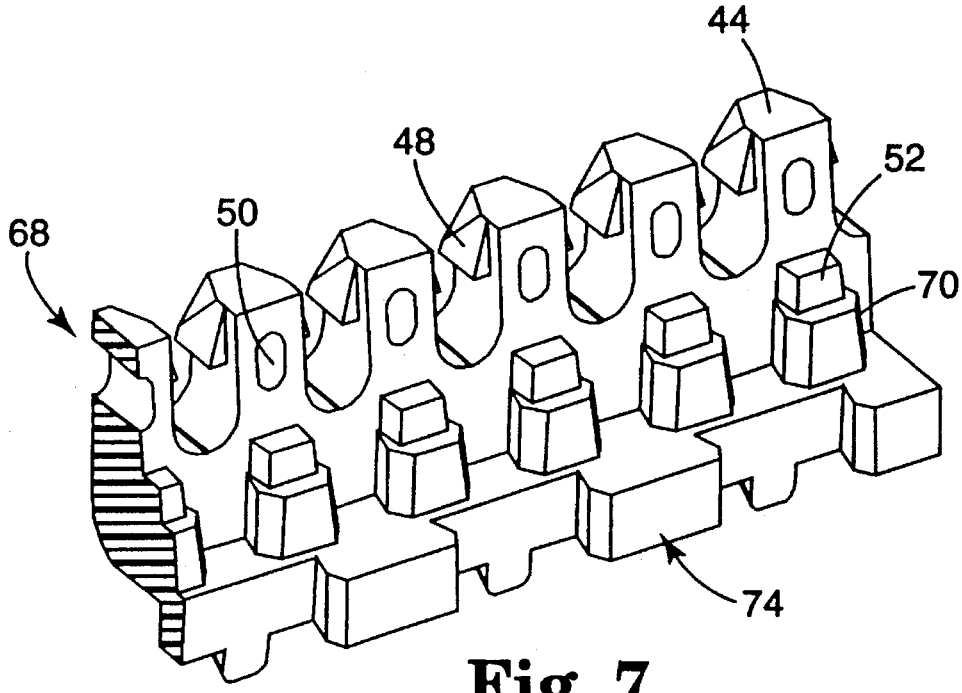
FIG. 7 is a perspective view and section of an alternative, single-side wire retention strip for use with the connector body of FIG. 6.

FIG. 6 depicts an alternative body bottom 64 which is similar to the bottom portion of the connector body used in the prior art 4005DPM $MS^2$ connector body design ("4005DPM" is a trademark of 3M). Body bottom 64 imparts stackability to the $MS^2$ design; each contact element has an IDC at one end and a twisted plug on the other end, the plug passing through cutouts 66 in body bottom 64. Channels are again formed to define the test ports. Body bottom 64 has the same hook construction as the connector cover to secure body bottom 64 onto the upper surface of another top portion 12. The single-sided wire retention strip 68 of FIG. 7 should be used with body bottom 64 to prevent interference with any pair-splitter strip mounted on the lower portion of the stacked module. While the dovetail feature is still used to attach single-sided strip 68 to body bottom 64, dovetail protrusions 70 are smaller since they engage only the dovetail notches of another top portion 12, as a result of the geometry of body bottom 64. A different set of dovetail notches 72 with a wider ledge is incorporated to engage the wider dovetail protrusions 74 formed on single-sided strip 68. Single-sided strip 68 may also be attached to the wire cut-off side of the connector stack.

Figure 8:
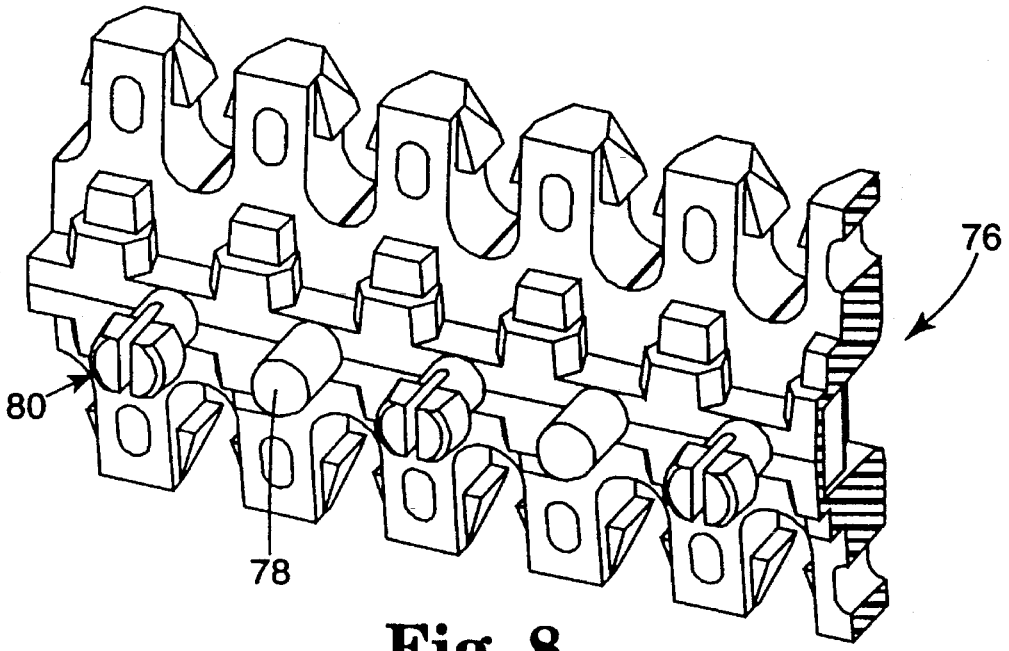
FIG. 8 is a perspective view and section of an alternative wire retention strip used in conjunction with a connector body having test ports.

The embodiment of FIG. 8 provides a wire cut-off side strip 76 having a plurality of posts 78 for mating with test ports located in the connector body. Some of the posts may be provided with a flange or catch 80 which engages an inner annular trough or groove (not shown) formed in the test ports. Wire cut-off side strip 76, as well as any of the foregoing strips, may be adapted to improve moisture protection and sealing of the connector by adding an encapsulant in the strip. The various strips may also be color-coded according to functionality, or could be clear for easier visual inspection of the connections.

The dimensions of connector body 10 and the various strips described herein may vary considerably depending upon the particular application. The following approximate dimensions are considered exemplary, based on the dimensions of the prior art $MS^2$ design. For a 25 connector module, the length of connector body 10 is 16.5 cm, its width is 15 mm, and the combined height of top and bottom portions 12 and 14 is 7 mm. Wire channels 16 are 3 mm apart. The strips are no higher than 10 mm, and the wire retainers (posts) on the strips provide a wire density of at least 3 wires/cm. Posts 44 are 1.5 mm wide, with wedges 48 extending 0.36 mm on either side thereof. Holes 50 have a width of 0.76 mm. Dovetail protrusions 42 have a maximum width of 1.9 mm, with cavities 28 having a slightly larger maximum rear width and slightly smaller minimum width.

There are many functional advantages associated with the foregoing designs. Since the strip is molded as a separate piece, the design of the wire retention feature is not constrained by the connector body molding geometry. The materials used in the strip can be selected, designed, and molded independent of the material requirements of the basic connector. This flexibility in material properties affords the opportunity to fine-tune both the strip design and material selection to meet the application requirements. A wide variety of add-on strips with various functions can be provided to the end user; either attached to the connector, or separately, for field attachment, as appropriate to the connector application. This would enable the user to have one common connector to which specific enhancements may be added, as needed. The add-on strips are removable. If splice bundle size is more of a concern than wire retention in a given splice, the user can simply remove the wire retention strips. In the hand splicing application, the strips on the wire cut-off side of the connector are not needed after hand splicing is completed. Their removal will reduce the size of the connector splice bundle and also allow the use of a standard sealant box. The strips may also be re-used on another connector. All of the strip designs offer improvements in wire retention performance for large gauge wires, and also improve strain relief performance, even for small wires, in part because the distance from the wire connection (at the IDC) to the effective edge of the connector is increased. There are also several manufacturing advantages. The addition of the dovetail feature to the connector body latch rail can be made to all connectors. It is contained within the original connector footprint and does not alter connector compatibility. There is no adverse impact on molding the improved connector body, nor in ultrasonically welding the improved connectors in assembly. No changes are required in the existing assembly equipment to produce the improved connector bodies. The strips can be attached to the finished connectors using a simple pressing station at the end of the current assembly line. Variation in "product mix" demand can be easily accommodated, but the manufacturing efficiencies of the base improved connector are not impacted. Product mix adjustment will involve molding and attaching the inexpensive strips as needed. Inventories of completed assemblies with different body geometries can also be minimized.

Figure 9:
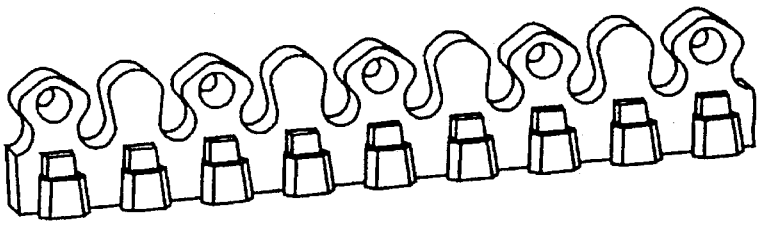
FIGS. 9 and 10 are perspective views of still additional embodiments of the wire retention strip constructed in accordance with the present invention.
Figure 10:
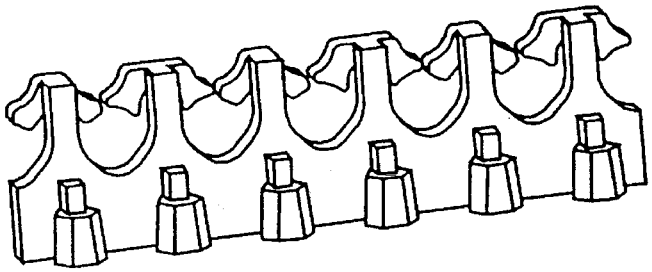

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. For example, FIGS. 9 and 10 depict two alternative wire-holding geometries. Other means for attaching the strips will also become apparent, such as mushroom-shaped protrusions or small posts with flattened ends which snap fit into cavities formed in the connector body. It is therefore contemplated that such modifications can be made without departing from the spirit or scope of the present invention as defined in the appended claims.

I claim:

1. A modular, multiple-pair wire connector comprising:

an elongate connector body having a top portion attached to a bottom portion, an upper surface, and a sidewall adjacent to and generally perpendicular with said upper surface, said upper surface further having a plurality of generally parallel wire channels;

a cover having a structured surface for removable attachment to said top portion of said connector body;

a plurality of metallic elements disposed in said connector body, each element having two ends, at least one of said ends having an insulation displacement contact disposed in said top portion of said connector body and pointing generally toward said cover; and a plurality of dovetail cavities formed in said sidewall of said connector body, each of said cavities being generally identical and interposed between said wire channels.

2. The connector of claim 1 wherein said connector body is constructed of a resilient material, and further comprising:

a wire retention strip not longer than said connector body, said strip having means tier retaining at least one of a first plurality of wires; and means for releasably securing said strip to said connector body such that said strip is generally parallel with said connector body, said securing means including at least one dovetail member integrally formed with said strip, said dovetail member being sized to mate with one of said dovetail cavities formed in said connector body.

3. The connector of claim 2 wherein:

said top and bottom portions of said connector body are both generally flat and have a common edge, the first plurality of wires exiting said connector body proximate said edge; and said strip is located adjacent said edge of said connector body when said strip is secured to said connector body.

4. The connector of claim 3 wherein said strip has integrally formed second means for retaining at least one of a second plurality of wires.

5. The connector of claim 3 wherein:

said retaining means includes at least two adjacent posts integrally formed with said wire retention strip along an edge thereof, said adjacent posts defining a slot for receiving one of the first plurality of wires when said wire retention strip is attached to said connector body;

each of said posts has a hole therein facilitating flexing of said post toward a centerline of said post; and said posts have angled faces and adjacent wedges for capturing one of the first plurality of wires in said slot.

6. The connector of claim 3 wherein:

said strip has an edge, one of the first plurality of wires traversing said edge of said strip when said strip is attached to said connector body; and said retaining means includes a rail member, said rail member including means for attachment to said strip along a portion of said edge thereof, and means for capturing one of the first plurality of wires between said edge and said rail member.

7. A system for interconnecting a first plurality of wires to a second plurality of wires, respectively, comprising:

an elongate connector body having a generally flat top portion constructed of a resilient material attached to a generally flat bottom portion constructed of a resilient material, said top and bottom portions having a common edge, the first plurality of wires exiting said connector body proximate said edge;

a cover having a structured surface for removable attachment to said top portion of said connector body;

a base having a structured surface for attachment to said bottom portion of said connector body, each of said connector body, cover and base having an end construction for alignment with a splice head;

a plurality of metallic elements disposed in said connector body, each element having two ends, each end having an insulation displacement contact, a first one of said contacts on each of said elements disposed in said top portion of said connector body and pointing generally toward said cover, and a second one of said contacts on each of said elements disposed in said bottom portion of said connector body and pointing generally toward said base;

a pair-splitter strip not longer than said connector body, said pair-splitter strip having integrally formed first means for retaining at least one of the first plurality of wires and second means for retaining at least one of the second plurality of wires, and having a plurality of dovetail members integrally formed with said pair-splitter strip, said dovetail members being sized to mate with respective cavities formed in said connector body;

a locking strip having means for receiving a locking rail member, said locking rail member further having means for capturing one of the first plurality of wires between an edge of said locking strip and said rail member;

a single-sided strip having means, located along only one edge of said single-sided strip, for retaining at least one of the first plurality of wires; and a wire cut-off side strip having means for retaining at least one of the first plurality of wires, and having a plurality of posts for mating with test ports located in said connector body.

* * * * *